US011499379B2

(12) United States Patent
Eriksen et al.

(10) Patent No.: US 11,499,379 B2
(45) Date of Patent: Nov. 15, 2022

(54) SYSTEM AND METHOD FOR SUBSEA WELL OPERATION

(71) Applicant: RIGTEC WELLSERVICE AS, Hafrsfjord (NO)

(72) Inventors: Morten Eriksen, Røyneberg (NO); Tor Egil Rolfsen, Hafrsfjord (NO)

(73) Assignee: RIGTEC WELLSERVICE AS, Hafrsfjord (NO)

( * ) Notice: Subject to any disclaimer, the term of this patent is extended or adjusted under 35 U.S.C. 154(b) by 0 days.

(21) Appl. No.: 17/440,536

(22) PCT Filed: Mar. 20, 2019

(86) PCT No.: PCT/EP2019/056963
§ 371 (c)(1),
(2) Date: Sep. 17, 2021

(87) PCT Pub. No.: WO2020/187411
PCT Pub. Date: Sep. 24, 2020

(65) Prior Publication Data

US 2022/0154537 A1 May 19, 2022

(51) Int. Cl.
*E21B 7/124* (2006.01)
*E21B 15/02* (2006.01)
(Continued)

(52) U.S. Cl.
CPC ..... *E21B 15/02* (2013.01); *E21B 7/124* (2013.01); *E21B 7/132* (2013.01); *E21B 19/083* (2013.01);
(Continued)

(58) Field of Classification Search
CPC ..... E21B 7/124; E21B 15/02; E21B 19/083; E21B 19/143; E21B 19/22
See application file for complete search history.

(56) References Cited

U.S. PATENT DOCUMENTS 4,165,690 A 8/1979 Abrahams
7,584,796 B2 * 9/2009 Ayling ..... E21B 7/124 166/380
(Continued)

FOREIGN PATENT DOCUMENTS

CN 102383723 B 6/2013
DE 2121007 A1 11/1972
(Continued)

OTHER PUBLICATIONS

International Preliminary Report on Patentability (IPRP) dated Sep. 6, 2021 for PCT International Application No. PCT/EP2019/056963, 34 pages.
(Continued)

*Primary Examiner* — Matthew R Buck
(74) *Attorney, Agent, or Firm* — RMCK Law Group, PLC

(57) ABSTRACT

A system for operation on a subsea well, the system comprising at least one storage unit configured to store tubulars; a subsea mast unit comprising at least two string handling devices configured to handle a tubular string of a plurality of connected tubulars, wherein at least one of the string handling devices is configured to move vertically relative to the other of the string handling devices, and is configured to add a vertical downforce to the tubular string; and at least one handling arrangement for moving tubulars between the at least one storage unit and one of the string handling devices simultaneously with handling of the tubular string by at least one of the string handling devices. A method of lowering a tubular string into a subsea well is also provided.

14 Claims, 5 Drawing Sheets

(51) Int. Cl.

| | |
|---|---|
| ***E21B 19/083*** | (2006.01) |
| ***E21B 19/14*** | (2006.01) |
| ***E21B 19/22*** | (2006.01) |
| ***E21B 7/132*** | (2006.01) |
| ***E21B 19/16*** | (2006.01) |

(52) U.S. Cl.
CPC ..... *E21B 19/143* (2013.01); *E21B 19/16* (2013.01); *E21B 19/22* (2013.01)

(56) References Cited

U.S. PATENT DOCUMENTS

| | | | | |
|---|---|---|---|---|
| 7,703,534 | B2 * | 4/2010 | Sheshtawy | E21B 7/124 166/57 |
| 9,322,220 | B2 * | 4/2016 | Innes | E21B 15/02 |
| 9,388,649 | B2 * | 7/2016 | Looijen | B63B 35/4413 |
| 9,822,613 | B2 | 11/2017 | Crawford et al. | |
| 2010/0147526 | A1 * | 6/2010 | Haughom | E21B 19/143 166/338 |
| 2021/0246728 | A1 * | 8/2021 | Elliot | E21B 7/20 |

FOREIGN PATENT DOCUMENTS

| | | | |
|---|---|---|---|
| EP | 1507952 | A2 | 2/2005 |
| EP | 2588703 | A1 | 5/2013 |
| GB | 1580790 | A | 12/1980 |
| WO | 03093625 | A2 | 11/2003 |
| WO | 2004018826 | A1 | 3/2004 |
| WO | 2007004887 | A1 | 1/2007 |
| WO | 2012000077 | A1 | 1/2012 |

OTHER PUBLICATIONS

PCT International Search Report and Written Opinion dated Nov. 27, 2019 for PCT International Application No. PCT/EP2019/056963, 11 pages.

* cited by examiner

SYSTEM AND METHOD FOR SUBSEA WELL OPERATION

CROSS-REFERENCE TO RELATED APPLICATIONS

This application is a 371 U.S. National Stage of International Application No. PCT/EP2019/056963, filed Mar. 20, 2019. The disclosure of the above application is incorporated herein by reference in its entirety.

TECHNICAL FIELD

The present disclosure generally relates to subsea well operations. In particular, a system for operation on a subsea well and a method of lowering a tubular string into a subsea well, are provided.

BACKGROUND

When a subsea well has produced oil or gas over a period of time, it may be necessary with a workover to clean the well for sand etc. Workovers are also known as interventions. Well workovers in subsea wells may be conducted from a surface drilling rig and through a drilling riser. So-called heavy workover (HWO) operations on subsea wells require the use of a full size surface drilling rig. Such workovers are very expensive.

As an alternative to surface drilling rigs, it is known to perform workovers from a vessel by means of coil tubing. However, coil tubing workovers are associated with several disadvantages. For example, a wave compensation system is needed and the tubing is weak, which leads to an increased risk for buckling.

Furthermore, in many wells, the well casing may also have approached the fatigue limit. Existing solutions for workover on these wells are either too heavy or too expensive. The possibility to open wells for production again, or increase production, could be very profitable if the costs associated with the workover are reduced.

U.S. Pat. No. 9,822,613 B2 discloses a system for inserting a tubular member from a surface into a subsea well. The system includes a riserless vessel, a surface injector being mounted on the vessel at the surface and delivering tubular member, such as coiled tubing, to the subsea well from the surface, a subsea snubbing jack releasably engaged to the tubular member, a subsea hydraulic power unit connected to the snubbing jack, and a device to maintain tension of the tubular member between the surface injector and the snubbing jack.

SUMMARY

One object of the present disclosure is to provide a system for operation on a subsea well, which system is cost-effective. That is, a system that reduces costs associated with operations on a subsea well, such as workover, drilling and plug and abandonment.

A further object of the present disclosure is to provide a system for operation on a subsea well, which system is flexible.

A still further object of the present disclosure is to provide a system for operation on a subsea well, which system is easy to install, deinstall and transport.

A still further object of the present disclosure is to provide a system for operation on a subsea well, which system requires relatively little assistance from a vessel and thereby enables use together with lighter vessels.

A still further object of the present disclosure is to provide a system for operation on a subsea well, which system enables an operation on a subsea well to be performed in a shorter time.

A still further object of the present disclosure is to provide a system for operation on a subsea well, which system provides a reliable operation.

A still further object of the present disclosure is to provide a system for operation on a subsea well, which system solves several or all of the foregoing objects in combination.

A still further object of the present disclosure is to provide a method of lowering a tubular string into a subsea well, which method solves one, several or all of the foregoing objects.

According to one aspect, there is provided a system for operation on a subsea well, the system comprising at least one storage unit configured to store tubulars; a subsea mast unit comprising at least two string handling devices configured to handle a tubular string of a plurality of connected tubulars, wherein at least one of the string handling devices is configured to move vertically relative to the other of the string handling devices, and is configured to add a vertical downforce to the tubular string; and at least one handling arrangement for moving tubulars between the at least one storage unit and one of the string handling devices simultaneously with handling of the tubular string by at least one of the string handling devices.

Snubbing is a technology where a tubular string is made up and broken up by adding or removing rigid tubulars, in contrast to coil tubing where a pipe is spooled off a drum. If snubbing is performed from a production platform at sea surface level, the weight of the tubular string is sufficient to overcome the reservoir pressure. By means of the at least one string handling device configured to add a vertical downforce to the tubular string, the system according to the present disclosure enables subsea snubbing without having to hydrostatically balance the reservoir pressure. At least one of the string handling devices may be configured to snub or push the tubular string downwards to overcome the reservoir pressure. The at least one string handling device may be configured to add an adjustable vertical downforce to the tubular string.

One or each string handling device of the system may be configured to provide the full snubbing force to the tubular string. That is, one or each string handling device may be configured to provide a vertical downforce that overcomes the reservoir pressure within the well. The system thereby enables pushing (snubbing) or pulling of the tubular string into or out from a pressurized well. The system may for example be configured to operate on subsea wells at water depths of 500 m, with a well pressure of 35 MPa (approximately 5000 psi), and with well depths of 5000 m.

Furthermore, in use of the system, each string handling device may remain over the well center, i.e. over the center line of the tubular string. Since the at least one handling arrangement provides the handling of tubulars to and from the at least one storage unit, the string handling devices do not have to move out from well center for handling tubulars. The at least one handling arrangement may thus move tubulars between the at least one storage unit and one of the string handling devices positioned over the well center. This improves speed and reliability of the system. The at least one handling arrangement may be configured to move single tubulars and/or configured to move a stand of two or more connected tubulars between the at least one storage unit and one of the string handling devices.

The at least one handling arrangement and at least one of the string handling devices are thus configured to work in parallel. The at least one handling arrangement can move a tubular (or a stand of two or more connected tubulars) to or from the tubular string at the same time as the tubular string is handled by at least one of the string handling devices.

The at least one string handling device may be configured to add a vertical downforce to the tubular string by clamping and pushing the tubular string downwards. Furthermore, at least one of the string handling devices may be configured to connect a tubular to the tubular string and to disconnect a tubular from the tubular string.

As used herein, an operation on a subsea well may comprise any operation serving to increase, maintain or facilitate production of oil or gas from the well. Thus, the system according to the present disclosure can carry out various operations on a subsea well, such as snubbing, workover, drilling, and plug and abandonment operations.

Due to the subsea mast unit from which the vertical downforce is added to the tubular string, the system can carry out heavy workover operations on the subsea well with assistance only from a light workover vessel, rather than from a full size surface drilling rig or a dedicated drilling or well intervention vessel. Operations on a subsea well can thereby be performed by the system with minimum of influence of weather conditions, such as waves.

The system may be configured to perform heavy workover (HWO) operations on a subsea well together with a light intervention vessel. The system may be remotely operated, e.g. from the vessel.

Throughout the present disclosure, the tubulars may be rigid. The tubulars may for example be steel pipes. The tubulars may or may not be constituted by regular drill pipes. Each storage unit may comprise a rack for storing tubulars.

The mast unit may alternatively be referred to as a rig unit. The mast unit may comprise a derrick. Furthermore, the mast unit may comprise a base structure. When the mast unit is installed and the system is operative, the base structure is stationary. At least one of the string handling devices is thus configured to move vertically relative to the base structure and the at least one handling arrangement is thus configured to move tubulars relative to the base structure.

Each handling arrangement may be configured to transport tubulars to and from the tubular string. According to one example, each of the at least one handling arrangement comprises three moving devices. Two moving devices may be provided in the mast unit and one moving device may be provided in the storage unit. The system may comprise one handling arrangement associated with each storage unit. In case the system comprises two storage units, the system may comprise two handling arrangements and six moving devices, e.g. four moving devices in the mast unit and one moving device in each storage unit.

Each of the at least one storage unit may be a subsea storage unit. In this case, the system constitutes a subsea system. The system can thus perform its operation under water without any transportation of tubulars to/from surface level.

Each string handling devices may be configured to move vertically relative to the other of the string handling devices, and may be configured to add a vertical downforce to the tubular string. The string handling devices can thereby snub tubulars into the well at continuous, or substantially continuous, speed.

The vertical downforce may be at least 50 kN, such as at least 100 kN, such as at least 300 kN. The magnitude of the vertical downforce may be controlled by a control system, e.g. on the vessel. The control system for controlling the vertical downforce may be autonomous.

At least one of the string handling devices may additionally be configured to hold, pull and rotate a tubular string. Each string handling device may comprise a slip bowl configured to hold the weight of the tubular string and to hold the tubular string against the force applied by the well pressure. Each slip bowl may be configured to hold the vertical tubular string by applying a clamping force around the tubular string. Furthermore, each string handling device may comprise a swivel for rotating the tubular string.

The system may further comprise at least one rack and pinion drive arranged to drive one of the string handling devices vertically. The at least one rack and pinion drive may be provided in the mast unit, such as on the base structure of the mast unit. The at least one rack and pinion drive may be configured to (e.g. dimensioned to) apply a vertical downforce and a vertical upforce on the tubular string.

The at least one storage unit and the mast unit may be modular. The system may further comprise a modular blow out preventer unit comprising a blow out preventer (BOP), such as a BOP stack. Thus, the system can be completely assembled and made ready for operation with only three (or four in case the system comprises two modular storage units) main units lifted from the vessel, lowered to the subsea well and installed on an existing wellhead assembly, such as a Christmas tree. The main units may be connected just below the surface, before being lowered to the wellhead assembly. Alternatively, the main units may be lowered to the wellhead assembly and installed one by one.

The system may further comprise at least one buoyant device for counteracting the weight of the mass of the system under water. The at least one buoyant device may be configured to provide a permanent and/or adjustable buoyant force to the system. According to one example, the system comprises at least one buoyant device with permanent buoyancy (e.g. corresponding to a gravity weight of 80 tons to 120 tons), and at least one buoyant device with adjustable buoyancy (e.g. corresponding to a gravity weight of between 0 tons and 60 tons).

At least one buoyant device may be connected to each of the one or more storage units and the mast unit. At least one buoyant device may also be connected to the blow out preventer unit.

The system may have a mass of 150 tons to 250 tons, such as 200 tons. Due to the at least one buoyant device, the weight of the system may correspond to a gravity weight of less than 100 tons, such as zero, or close to zero, on the subsea well. The load on the wellhead assembly can thus be reduced, which is advantageous for older wellheads that have approached the fatigue limit. The at least one buoyant device reduces wear and tear on the wellhead assembly. Furthermore, the at least one buoyant device facilitates operations on many different subsea wells, e.g. at different depths, to be carried out by the same system.

The system may comprise two storage units and two handling arrangements for moving tubulars between a respective storage unit and one of the string handling devices simultaneously with handling of the tubular string by at least one of the string handling devices. The two storage units may be oppositely arranged with respect to the mast unit. Tubulars can thereby be moved to (and from) the mast unit from two sides, which increases speed and provides redundancy.

The at least one storage unit may be configured to store tubulars in a substantially vertical, or vertical, orientation. The substantially vertical orientation of the tubulars may be generally maintained during movement between the tubular string and the respective storage unit. The at least one storage unit may be configured to store single tubulars, or stands of two or more connected tubulars, in a substantially vertical, or vertical, orientation.

The system may be configured to operate by means of an electrical power supply. To this end, the system may further comprise an umbilical or wireline for electrically powering the system from a vessel. The system can thus be remotely operated from the vessel via the umbilical. The vessel may be a light workover vessel.

The system may further comprise a fluid line for fluid communication with a vessel, and a fluid connection device for establishing a fluid connection between the fluid line and the tubular string. The fluid connection device may comprise a Kelly swivel. The fluid line may be used to supply fluid to the tubular string and for well returns. The well returns may be handled, e.g. cleaned, on the vessel without assistance from a production platform. The well returns may contain water, sand and oil. The sand and oil may be stored in separate tanks on the vessel.

The system may further comprise at least one pump. The at least one pump may be provided on the vessel or under water.

According to a further aspect, there is provided a method of lowering a tubular string into a subsea well, the method comprising repeatingly moving tubulars to a tubular string and connecting the tubulars to the tubular string; and continuously or intermittently pushing the tubular string downwards by adding a vertical downforce to the tubular string; wherein the vertical downforce is added at a subsea location. The method may be referred to as a trip-in operation. The repeated moving of tubulars to the tubular string may be carried out by at least one handling arrangement according to the present disclosure. The connecting of tubulars to the tubular string and the pushing of the tubular string may be carried out by one or more string handling devices according to the present disclosure.

The repeated moving of tubulars may comprise moving single tubulars to the tubular string and connecting single tubulars to the tubular string. Alternatively, the repeated moving of tubulars may comprise moving stands of two or more connected tubulars to the tubular string and connecting the stands to the tubular string.

According to a further aspect, there is provided a method of installing a system for operation on a subsea well, the method comprising providing a modular blow out preventer unit; providing at least one modular subsea storage unit configured to store tubulars; providing a modular subsea mast unit comprising at least two string handling devices configured to handle a tubular string of a plurality of connected tubulars, wherein at least one of the string handling devices is configured to move vertically relative to the other of the string handling devices, and is configured to add a vertical downforce to the tubular string; lowering the blow out preventer unit into water; lowering the mast unit into water; lowering the at least one storage unit into water; and connecting the mast unit, the blow out preventer unit and the at least one storage unit below water.

The method may further comprise connecting the mast unit, the blow out preventer unit and the at least one storage unit below surface level, and lowering the connected units to the subsea well in a connected state. The blow out preventer may then be connected to the wellhead assembly. Thus, the system can be lowered to the subsea well, e.g. from a vessel, in an assembled state as one unit.

Alternatively, the method may further comprise lowering the blow out preventer unit to the subsea well; attaching the blow out preventer unit to the wellhead assembly; lowering the mast unit to the subsea well; attaching the mast unit to the blow out preventer unit; lowering the at least one storage unit to the subsea well; and attaching the at least one storage unit to the blow out preventer unit and/or to the mast unit. Thus, the system can be lowered to the subsea well, e.g. from a vessel, in a modular non-assembled state as several units.

In any case, the method may further comprise adjusting the buoyancy of each unit or of the assembled system. The method may further comprise providing at least one storage unit according to the present disclosure. The method may further comprise providing a mast unit according to the present disclosure. The method may further comprise providing a modular blow out preventer unit according to the present disclosure. The method may further comprise providing at least one handling arrangement for moving tubulars between the at least one storage unit and one of the string handling devices simultaneously with handling of the tubular string by at least one of the string handling devices.

BRIEF DESCRIPTION OF THE DRAWINGS

Further details, advantages and aspects of the present disclosure will become apparent from the following embodiments taken in conjunction with the drawings, wherein.

DETAILED DESCRIPTION

Figure 1:
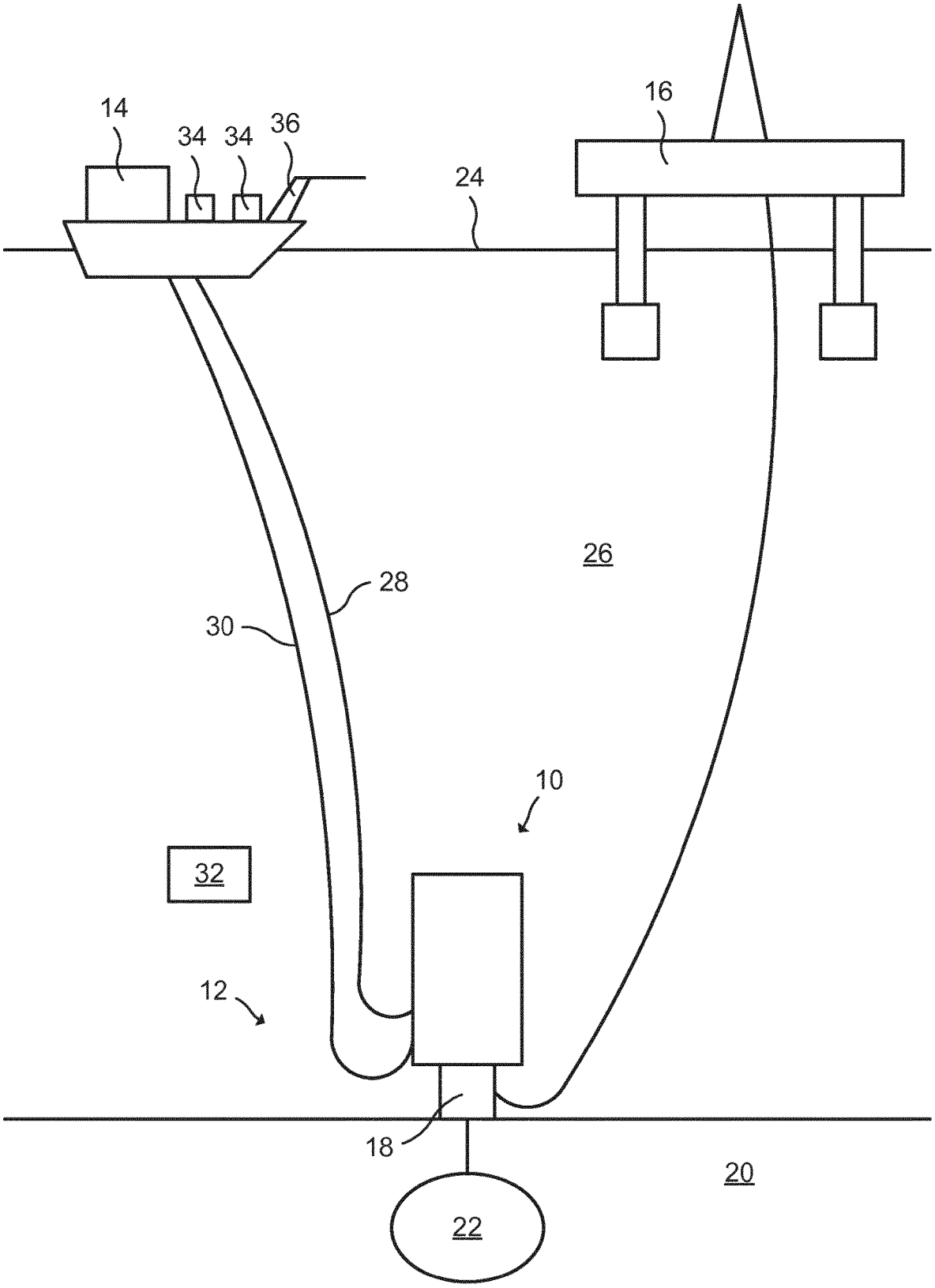
FIG. 1: schematically represents a side view of a system, a vessel and a production platform.

In the following, a system for operation on a subsea well and a method of lowering a tubular string into a subsea well, will be described. The same reference numerals will be used to denote the same or similar structural features.

FIG. 1 schematically represents a side view of one example of a system 10 for operation on a subsea well 12. FIG. 1 further shows a light intervention vessel 14 and a production platform 16. The system 10 is connected to a wellhead assembly 18 on a seabed 20 above a reservoir 22 containing oil or gas. The reservoir 22 may be located at a depth of up to 5000 m below the seabed 20.

The vessel 14 and the production platform 16 float on a surface 24 of the sea 26. The platform 16 may alternatively be standing on the seabed 20 and reach above the surface 24.

In the example in FIG. 1, system 10 is positioned subsea, i.e. in an underwater environment. The system 10 is a remotely operated heavy workover unit for use together with the light intervention vessel 14.

The system 10 in FIG. 1 further comprises an umbilical 28, such as a high-voltage cable, for electrically powering the system 10 from the vessel 14. The system 10 can thus be remotely operated via the umbilical 28. The system 10 in FIG. 1 further comprises a fluid line 30. The fluid line 30 is used for fluid communication between the system 10 and the vessel 14.

The system 10 further comprises a remotely operated vehicle (ROV) 32 for providing assistance to the system 10. FIG. 1 further shows one or more pumps 34 positioned on the vessel 14. The pumps 34 may alternatively be positioned subsea adjacent to the wellhead assembly 18. The vessel 14 of this example further comprises a crane 36, power supply and equipment for well return treatment.

As shown in FIG. 1, the interface between the system 10 on the well 12 and the vessel 14 comprises the umbilical 28 and the fluid line 30. The only assistance by the vessel 14 may be to transport the system 10 to/from the well 12, to electrically power the system 10 through the umbilical 28 and to handle well returns through the fluid line 30. There is no rigid mechanical connection between the vessel 14 and the system 10. The system 10 can for example perform subsea snubbing without the use of a drilling riser.

The production platform 16 may be disconnected from the wellhead assembly 18 prior to installing the system 10. During operation, the vessel 14 assists the system 10 via the fluid line 30, supplies power to the system 10 via the umbilical 28, and performs well return treatment.

Figure 2:
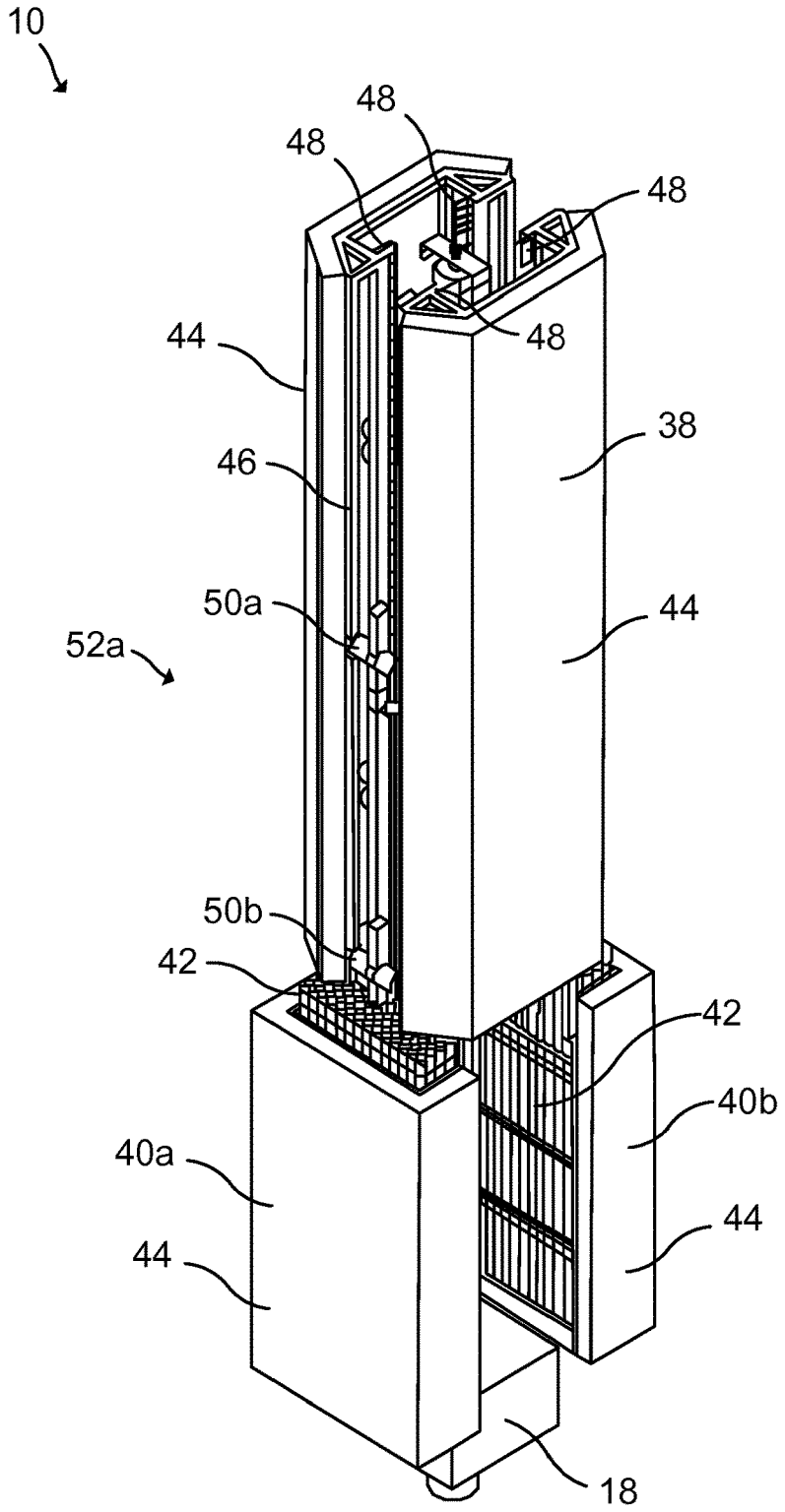
FIG. 2: schematically represents a perspective view of the system in FIG. 1.

FIG. 2 schematically represents a perspective view of the system 10 in FIG. 1.

As shown in FIG. 2, the system 10 comprises a subsea mast unit 38 and two subsea storage units 40*a*, 40*b*. Thus, in this example, the system 10 is a subsea system. Each storage unit 40*a*, 40*b* is configured to store tubulars 42 in a vertical orientation.

The system 10 comprises a plurality of buoyant devices 44. One buoyant device 44 is connected to each storage unit 40*a*, 40*b* and two buoyant devices 44 are connected to the mast unit 38. The buoyant devices 44 counteract the weight of the mass of the system 10 under water by providing a permanent and/or adjustable buoyancy.

The mast unit 38 comprises a stationary base structure 46 and a plurality of rack and pinion drives 48. FIG. 1 further shows two moving devices 50*a*, 50*b* of a handling arrangement 52*a* which is described below.

Figure 3:
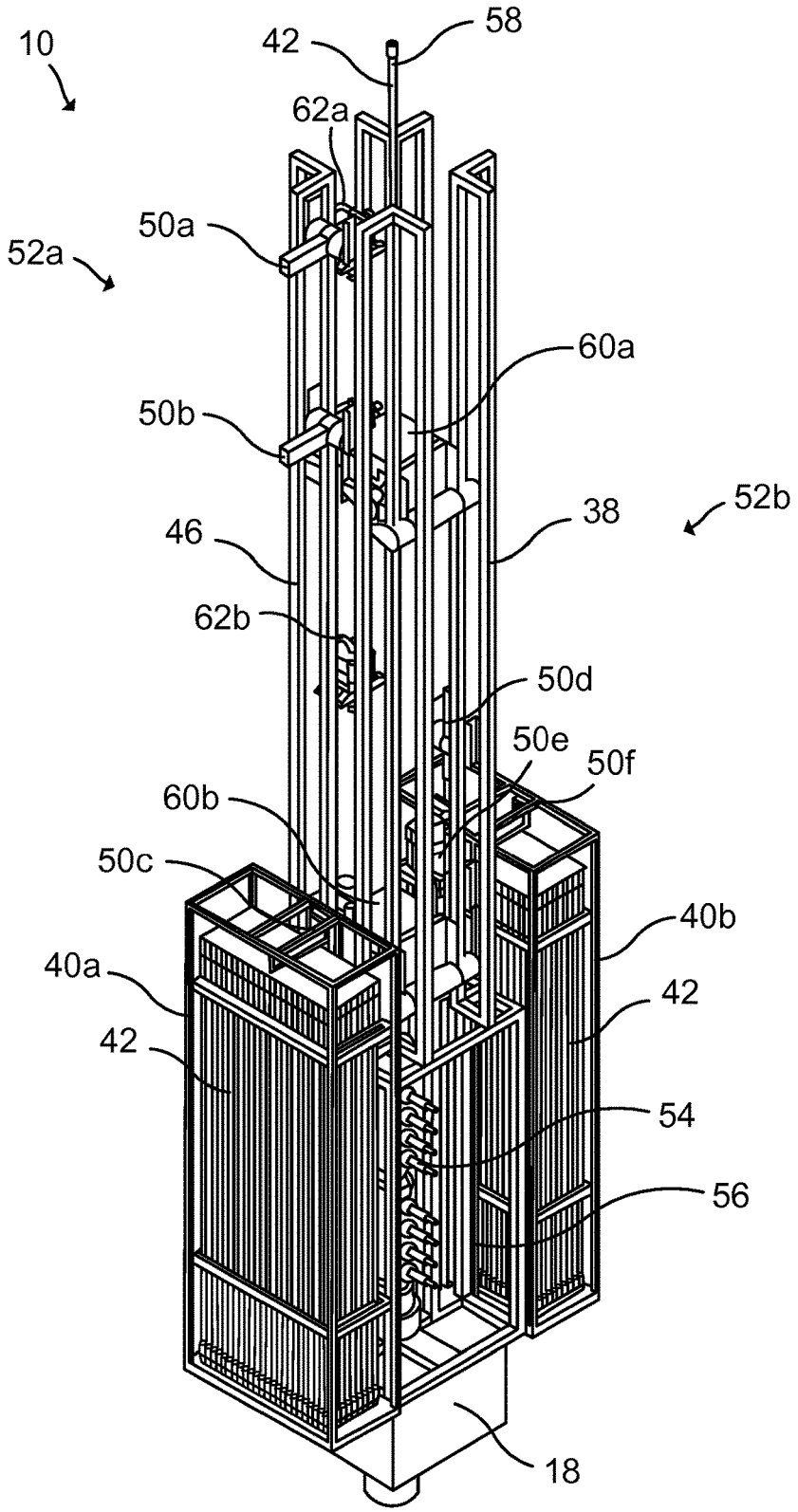
FIG. 3: schematically represents a perspective view of the system in FIGS. 1 and 2 with buoyant devices removed.
Figure 4:
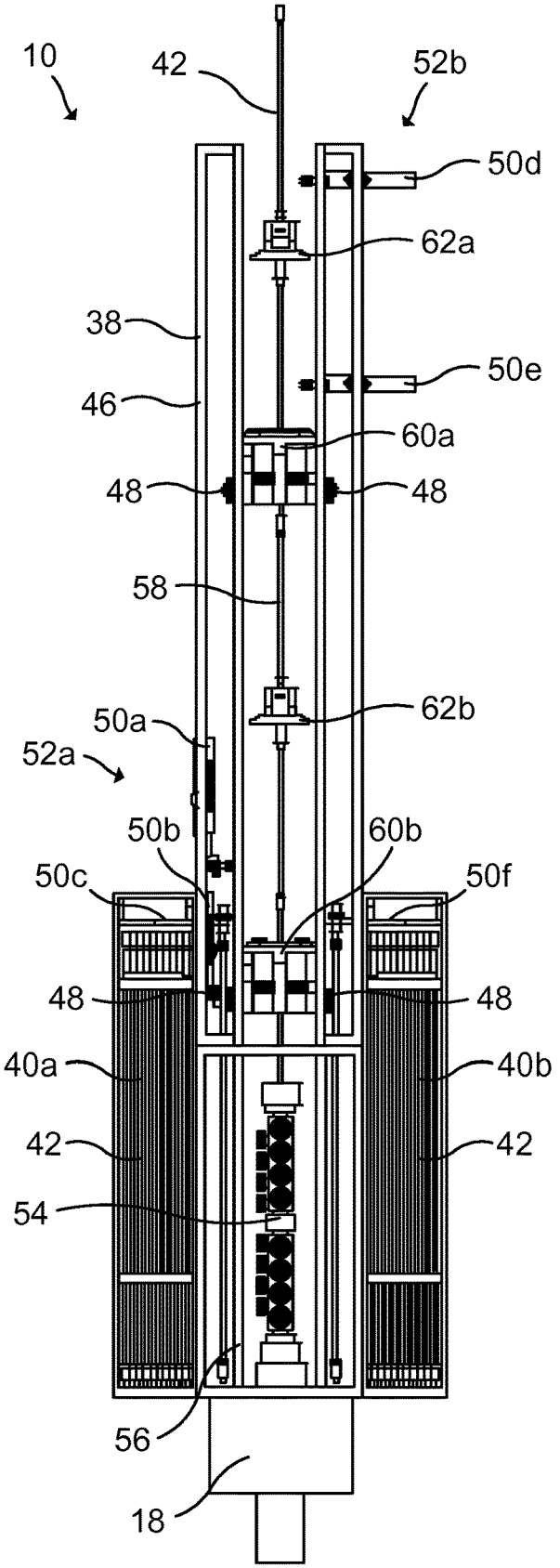
FIG. 4: schematically represents a front view of the system in FIG. 3.

FIG. 3 schematically represents a perspective view of the system 10 in FIGS. 1 and 2. In FIG. 3, the buoyant devices 44 are removed to improve visibility. FIG. 4 schematically represents a front view of the system 10 in FIG. 3, and FIG. 5 schematically represents a side view of the system 10 in FIGS. 3 and 4.

Figure 5:
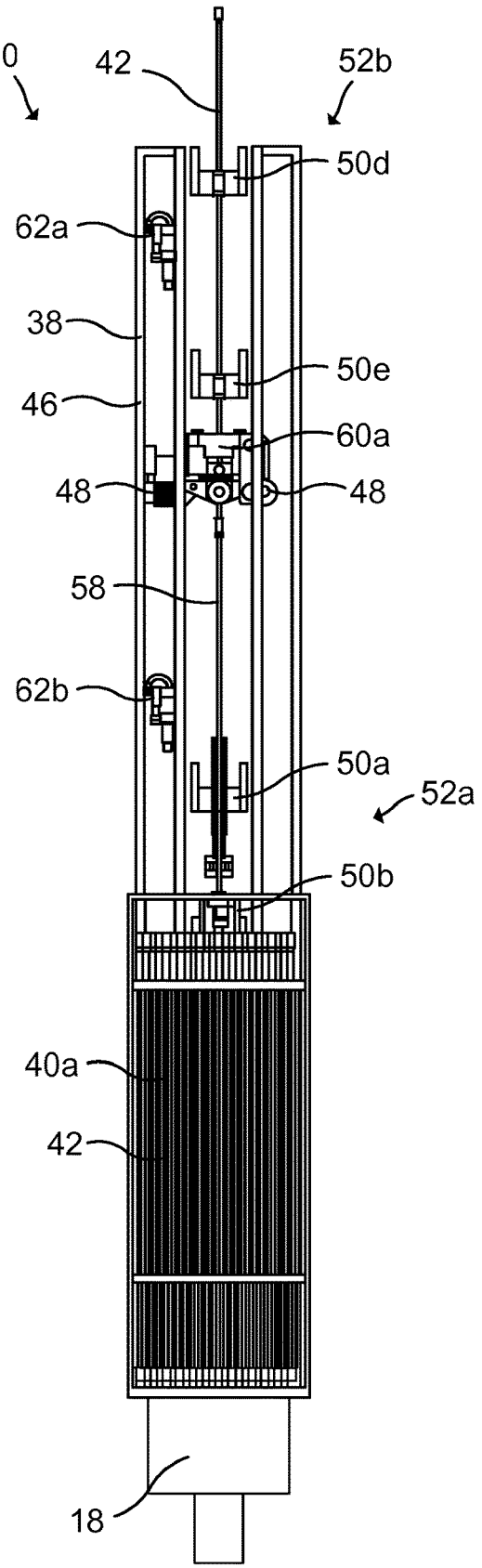
FIG. 5: schematically represents a side view of the system in FIGS. 3 and 4.

With collective reference to FIGS. 3-5, the system 10 further comprises a blow out preventer (BOP) 54 provided in a blow out preventer unit 56. Control lines (not illustrated), such as choke, kill and flush lines, may be provided between the vessel 14 and the BOP 54. The height of the system 10 may be 20 m to 30 m, the height of the mast unit 38 may be 15 m to 25 m, the height of each storage unit 40*a*, 40*b* may be 8 m to 12 m, and the height of the BOP unit 56 may be 5 m to 10 m. The BOP unit 56 may be connected to the wellhead assembly 18 by means of standard connections of the same type as used when connecting drilling BOP's to wellheads. The connections can be established by the assistance of the ROV 32.

The mast unit 38, the BOP unit 56 and the two storage units 40*a*, 40*b* form four modules. The system 10 can be transported in modules on the vessel 14 to the location. The modules can then be lowered from the vessel 14 to the well 12 with the crane 36 and installed to the wellhead assembly 18.

By means of the buoyant devices 44, the system 10 can be put on the wellhead assembly 18 with light force, either by lowering the entire system 10 after being assembled just below the surface 24, or by sequentially lowering and installing the BOP unit 56, the mast unit 38 and the storage units 40*a*, 40*b* one by one. In any case, the lowering may be carried out by means of the crane 36.

Once the storage units 40*a*, 40*b* have been lowered to the well 12, no handling of tubulars 42 takes place on the vessel 14. Thereby, the need for a wave compensation system onboard the vessel 14 can be avoided.

FIGS. 3-5 further show a tubular string 58 comprising a plurality of connected tubulars 42. The length of each tubular 42 may for example be 8 to 12 meters, such as approximately 10 meters. The ends of each tubular 42 may be threaded to be threadingly engaged with an adjacent tubular 42 or an intermediate joint member.

FIGS. 3-5 shows that the system 10 of this example comprises two handling arrangements 52*a*, 52*b*. Each handling arrangement 52*a*, 52*b* is associated with one storage unit 40*a*, 40*b*. Four moving devices 50 are provided in the mast unit 38, two on each side of the tubular string 58. The handling arrangement 52*a* comprises three moving devices 50*a*, 50*b*, 50*c* and the handling arrangement 52*b* comprises three moving devices 50*d*, 50*e*, 50*f* (each moving device 50*a-f* may also be referred to with reference numeral "50"). Each moving device 50 comprises a gripping mechanism (not denoted) for gripping a tubular 42.

The system 10 of this example further comprises two string handling devices 60*a*, 60*b*. The string handling devices 60*a*, 60*b* are provided in the mast unit 38. The string handling devices 60*a*, 60*b* are configured to handle the tubular string 58. Each string handling devices 60*a*, 60*b* is independently drivable vertically up and down along the base structure 46 by the rack and pinion drives 48. By means of the rack and pinion drives 48, each string handling device 60*a*, 60*b* can move vertically up and down and can apply a vertical downforce and a vertical upforce to the tubular string 58.

Each handling arrangement 52*a*, 52*b* is configured to move tubulars 42 between the associated storage unit 40*a*, 40*b* and one of the string handling devices 60*a*, 60*b*, i.e. to the well center over the center line of the tubular string 58.

The moving devices 50*c*, 50*f* associated with a respective storage unit 40*a*, 40*b* are configured to move tubulars 42 generally laterally between storage positions within the respective storage unit 40*a*, 40*b* and a handover position outside each storage unit 40*a*, 40*b*. At the handover position of each storage unit 40*a*, 40*b*, the tubular 42 can be handed over to (or received from) one of the moving devices 50*a*, 50*b*, 50*d*, 50*e* of the mast unit 38.

Each storage unit 40*a*, 40*b* may comprise a fingerboard at the bottom with a plurality of upright fingers (not shown). The tubulars 42 can be held stably by being positioned over a respective finger.

The moving devices 50*a*, 50*b* are configured to receive (and vice versa) tubulars 42 from the moving device 50*c* at the handover position outside the storage unit 40*a*. The moving devices 50*d*, 50*e* are configured to receive (and vice versa) tubulars 42 from the moving device 50*f* at the handover position outside the storage unit vb. The moving devices 50*a*, 50*b*, 50*d*, 50*e* can move tubulars 42 vertically upwards from the handover position and then laterally towards the tubular string 58.

FIGS. 3-5 further show that the system 10 comprises two fluid connection devices 62*a*, 62*b*. One of the fluid connection devices 62*a*, 62*b* can be connected to the fluid line 30 and connected on top of one of the string handling device 60*a*, 60*b*. In this example, one of the fluid connection devices 62*a*, 62*b* serves as backup. In FIGS. 3-5, the fluid connection devices 62*a*, 62*b* are in a standby position outside the well center.

Once the system 10 has been installed on the well 12, preparations such as pressure testing of the system 10 may be carried out. When the preparations are complete, the operations of the system 10 will start. Since the vessel 14 comprises the pumps 34 and the necessary equipment for well return treatment, assistance by the production platform 16 is not needed, which is of great advantage.

A bottom hole assembly (BHA, not shown) is lowered through the BOP 54 while the well pressure is sealed off. Once the BHA is through the BOP 54, an annular will seal off the well pressure while snubbing (i.e. pushing) the tubular string 58 into the well 12.

FIGS. 6*a*-6*d* schematically represent front views of the system 10 in FIGS. 3-5 in different states when the tubular string 58 is snubbed or tripped in to the well 12, e.g. for intervention work.

Figures 6A, 6B, 6C, 6D:
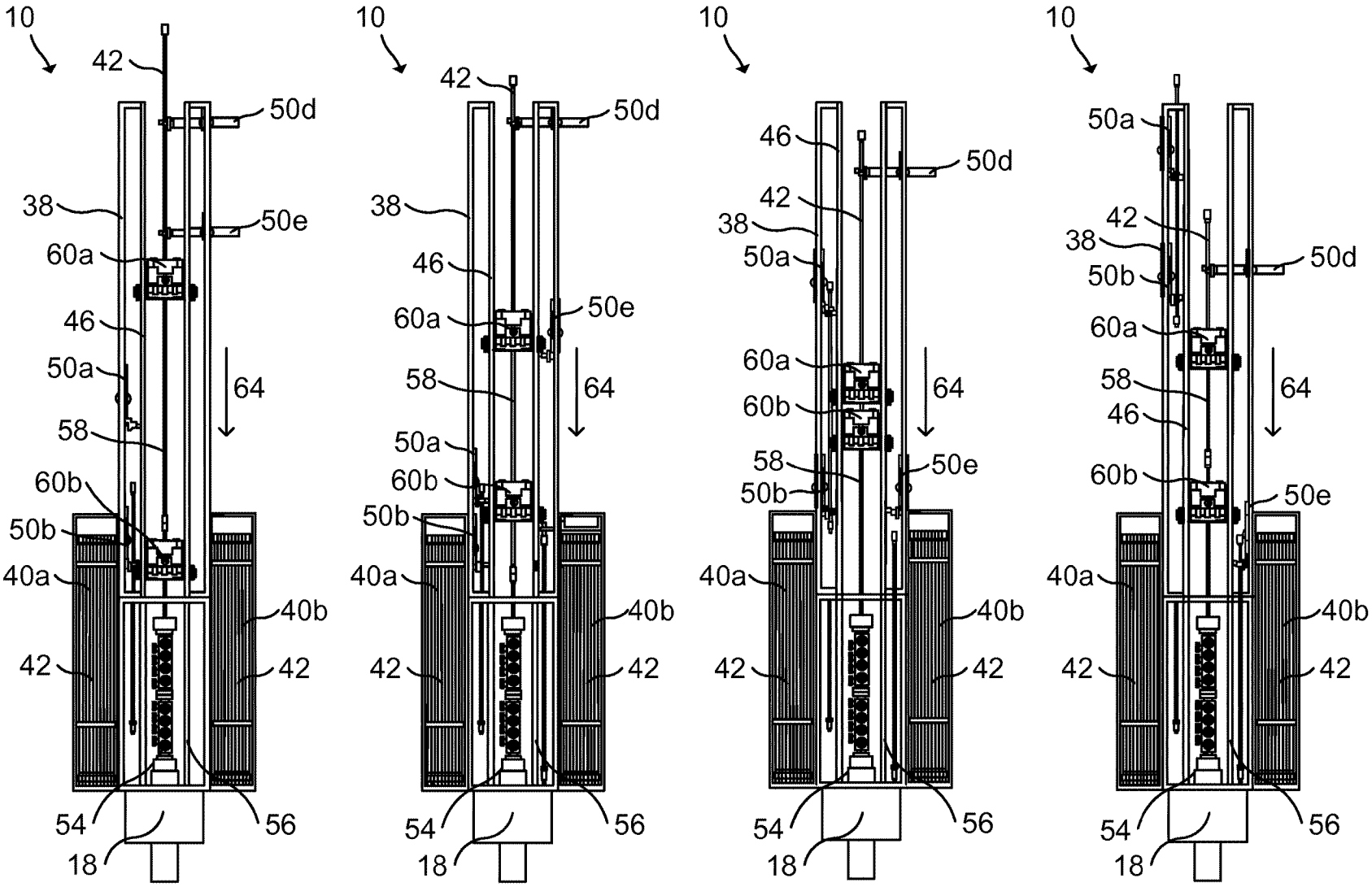
FIGS. 6*a*-6*d*: schematically represent front views of the system in FIGS. 3-5 in different states.

In FIG. 6*a*, the moving device 50*a* is moving down for grabbing a tubular 42 at a handover position outside the storage unit 40*a*. The moving devices 50*d*, 50*e* are positioned in a pick-up/delivery position over the well center. A tubular 42 delivered by the moving devices 50*d*, 50*e* has been screwed onto the tubular string 58 by rotation of the upper string handling device 60*a*. To this end, one or each string handling device 60*a*, 60*b* may comprise a screwing device.

The lower string handling device 60*b* has released its grip of the tubular string 58 and moves upwards. The upper string handling device 60*a* clamps around the tubular string 58 and applies a vertical downforce 64 to the tubular string 58. The tubular string 58 is thereby snubbed into the well 12 against the pressure of the reservoir 22. The moving devices 50 of the handling arrangements 52*a*, 52*b* thus operate simultaneously with the string handling devices 60*a*, 60*b*.

In FIG. 6*b*, the moving device 50*a* has gripped a tubular 42 at the handover position outside the storage unit 40*a*. The moving device 50*d* has gripped the top of the tubular string 58. The moving device 50*e* has released its grip on the tubular string 58. The upper string handling device 60*a* continues to push the tubular string 58 downwards and the lower string handling device 60*b* continues to move upwards along the tubular string 58.

In FIG. 6*c*, the moving devices 50*a*, 50*b* lift a tubular 42 vertically from the storage unit 40*a*. The moving device 50*d* moves down together with the tubular string 58 while gripping the tubular string 58. The moving device 50*e* moves down towards the handover position outside the storage unit vb. The lower string handling device 60*b* grips the tubular string 58. After this, the upper string handling device 60*a* releases its grip on the tubular string 58. The snubbing is thereby continued without interruption by the addition of the vertical downforce 64 by means of the lower string handling device 60*b*.

In FIG. 6*d*, the moving devices 50*a*, 50*b* have reached the top of the mast unit 38 and will initiate lateral movement of the tubular 42 into the well center on top of the tubular string 58. The moving device 50*d* has moved further down while gripping the tubular string 58 but will soon release its grip. The moving device 50*e* has reached the handover position outside the storage unit vb. The upper string handling device 60*a* has moved further upwards along the tubular string 58. The lower string handling device 60*b* has snubbed the tubular string 58 further down into the well 12.

The two handling arrangements 52*a*, 52*b* thus move tubulars 42 from the respective storage units 40*a*, 40*b* to the tubular string 58. Each tubular 42 is vertically oriented all the way from the storage unit 40*a*, 40*b* to the tubular string 58. The tubulars 42 are moved by the handling arrangements 52*a*, 52*b* from two sides of the mast unit 38. This increases speed of the tripping and provides redundancy.

Since the string handling devices 60*a*, 60*b* are always positioned over the well center during operation of the system 10, i.e. over the BOP 54, the snubbing does not have to be interrupted for collecting tubulars 42 by means of the string handling devices 60*a*, 60*b*. Rather, the string handling devices 60*a*, 60*b* and the handling arrangements 52*a*, 52*b* work in parallel. This enables continuous, or substantially continuous, snubbing.

In normal drilling into the well 12 by means of the production platform 16, there is typically a large vertical downforce due to the weight of the long drill string from the surface 24 and into the well 12. This weight of the drill string overcomes the vertical upforce on the drill string from the reservoir pressure.

Since the system 10 is positioned on the seabed 20, the weight of the tubular string 58 is relatively low and many times insufficient to overcome the vertical upforce on the tubular string 58 from the reservoir pressure. However, since each string handling device 60*a*, 60*b* is configured to add a vertical downforce 64 to the tubular string 58, subsea snubbing into the well 12 is enabled.

During the lowering of the tubular string 58 into the well 12, the reservoir pressure initially generates a great upward force on the tubular string 58. At least one of the string handling devices 60*a*, 60*b* overcomes this force from the reservoir pressure by adding a vertical downforce 64 to the tubular string 58. The fluid connection devices 62*a*, 62*b* remain in the standby position during the lowering of the tubular string 58.

Since each string handling device 60*a*, 60*b* is vertically movable and can add a vertical downforce 64 to the tubular string 58, the lowering of the tubular string 58 can be continuous, or substantially continuous. The system 10 can for example provide a tripping speed of 900 m/hour. Thereby, the system 10 enables subsea snubbing with the same speed as prior art coil tubing technologies, but also avoids disadvantages with coil tubing, for example buckling.

As the lowering of the tubular string 58 continues, the weight of the tubular string 58 will increase as further tubulars 42 are connected to the tubular string 58. The weight of the tubular string 58 will eventually overcome the vertical upforce on the tubular string 58 from the reservoir pressure. This state may be referred to as a tubular string float state.

When the tubular string 58 is lowered further after having reached the tubular string float state, the slip bowls of the string handling devices 60*a*, 60*b* will add a vertical upforce to (i.e. hold the weight of) the tubular string 58 instead of pushing the tubular string 58.

The tubular string 58 may be lowered to a problem area in the well 12 without adding any flow or pressurized fluid inside the tubular string 58. The problem area may be an area where sand and salt has stopped oil or gas production, e.g. by clogging perforations. When the BHA with intervention tools has reached the depth of the problem area, the lowering of the tubular string 58 is stopped and preparations for the intervention will start. One of the fluid connection devices 62*a*, 62*b* is connected on top of the upper string handling device 60*a*. This connection is handled by the mast unit 38.

The upper string handling device 60*a* is then operated as a topdrive and rotates the tubular string 58. At the same time, the pumps 34 on the vessel 14 is driven to pump salt water from the sea 26, through the fluid line 30 and through the tubular string 58 in order to clean the problem area from sand. This operation corresponds to a normal drilling operation but with pumped water instead of drilling mud.

During the intervention, the fluid connection device 62*a* is connected on top of the string handling device 60*a*. If a further tubular 42 needs to be added to the tubular string 58, the fluid connection device 62*a* is moved laterally out of the well center, the further tubular 42 is lifted into the well center and attached to the tubular string 58, the string handling device 60*a* is moved upwards to the top of the further tubular 42, and the fluid connection device 62*a* is then again connected on top of the string handling device 60*a*.

Alternatively, the further tubular 42 can be connected to the tubular string 58 between the two string handling devices 60*a*, 60*b*. In this case, the system 10 may comprise a third string handling device (not shown) below the two string handling devices 60*a*, 60*b* for holding the tubular string 58 when the upper string handling device 60*a* make up the connection between the further tubular 42 and the fluid connection device 62*a* and the lower string handling device 60*b* make up the connection between the further tubular 42 and the tubular string 58.

In any case, the fluid connection device 62*a* on top of the string handling device 60*a* can maintain a fluid connection between the tubular string 58 and the fluid line 30 while the tubular string 58 is rotated.

An inspection of the well 12 may then be carried out in order to see if the intervention has been successful or if any additional intervention operation is needed. The same intervention may be performed again, or a different intervention may be performed, for example by perforating the well with explosives in order to establish new channels for flow of gas or oil.

After completion of the intervention, the tubular string 58 is tripped out from the well 12. The procedure of tripping out the tubular string 58 may be reverse, or substantially reverse, to the trip-in procedure. The tubular string 58 is thus broken up and tubulars 42 are stored in the storage units 40*a*, 40*b*.

The system 10 can finally be disconnected from the wellhead assembly 18. The system 10 can be lifted back onto the vessel 14, either as one single unit or as separate units, and transported to another location. Alternatively, the system 10 can be suspended from the vessel 14 below the surface 24 and in this submerged state be transported to the next location, e.g. if the next location is relatively close.

The well returns transported through the fluid line 30 to the vessel 14 are cleaned onboard the vessel 14. Thus, together with the surface utilities from the vessel 14 provided through the umbilical 28 and the fluid line 30, the system 10 can repair and optimize the well 12 without any assistance from the production platform 16 and with low or little environmental impact. After the workover, the subsea well 12 ready for increased production can be handed over to the production platform 16.

With the snubbing and wireline capabilities, the system 10 provides a flexible and cost-effective alternative for keeping the well 12 at maximum production. Due to the subsea operation of the system 10, with assistance from the vessel 14 only through the umbilical 28 and the fluid line 30, it is possible to carry out operations on the well 12 with minimum influence by weather conditions. For example, the light vessel 14 does not require a wave compensation system. The repeated connection of rigid tubulars 42 to the tubular string 58 reduces the risk for buckling of the tubular string 58. Problem areas deeper into the well 12 can thereby be reached. Furthermore, the need to control bending cycles, as in coil tubing, can be avoided.

While the present disclosure has been described with reference to exemplary embodiments, it will be appreciated that the present invention is not limited to what has been described above. For example, it will be appreciated that the dimensions of the parts may be varied as needed. Accordingly, it is intended that the present invention may be limited only by the scope of the claims appended hereto.

The invention claimed is:

1. A system for operation on a subsea well, the system comprising:

at least one storage unit configured to store tubulars;

a subsea mast unit comprising at least two string handling devices configured to handle a tubular string of a plurality of connected tubulars; and at least one handling arrangement for moving tubulars between the at least one storage unit and one of the string handling devices simultaneously with handling of the tubular string by at least one of the string handling devices;

wherein each of the string handling devices is configured to move vertically relative to the other of the string handling devices, and is configured to add a vertical downforce to the tubular string; and wherein the vertical downforce is at least 50 kN.

2. The system according to claim 1, wherein each of the at least one storage unit is a subsea storage unit.

3. The system according to claim 1, wherein at least one of the string handling devices is configured to hold, pull and rotate a tubular string.

4. The system according to claim 1, further comprising at least one rack and pinion drive arranged to drive one of the string handling devices vertically.

5. The system according to claim 1, wherein the at least one storage unit and the mast unit are modular.

6. The system according to claim 1, further comprising a modular blow out preventer unit comprising a blow out preventer.

7. The system according to claim 1, further comprising at least one buoyant device for counteracting the weight of the mass of the system under water.

8. The system according to claim 1, wherein the system comprises two storage units and two handling arrangements for moving tubulars between a respective storage unit and one of the string handling devices simultaneously with handling of the tubular string by at least one of the string handling devices.

9. The system according to claim 8, wherein the two storage units are oppositely arranged with respect to the mast unit.

10. The system according to claim 1, wherein the at least one storage unit is configured to store tubulars in a substantially vertical orientation.

11. The system according to claim 1, wherein the system is configured to operate by means of an electrical power supply.

12. The system according to claim 1, further comprising a fluid line for fluid communication with a vessel, and a fluid connection device for establishing a fluid connection between the fluid line and the tubular string.

13. The system according to claim 1, wherein the vertical downforce is at least 100 kN.

14. The system according to claim 1, wherein the vertical downforce is at least 300 kN.

* * * * *